US007530138B1

(12) United States Patent
Platt

(10) Patent No.: US 7,530,138 B1
(45) Date of Patent: May 12, 2009

(54) TOILET BOWL CLEANING TOOL WITH DISPOSABLE SWAB

(76) Inventor: Garwood Isaac Platt, 4907 Old Tree Pl., Sarasota, FL (US) 34233

( * ) Notice: Subject to any disclaimer, the term of this patent is extended or adjusted under 35 U.S.C. 154(b) by 625 days.

(21) Appl. No.: 11/149,002

(22) Filed: Jun. 9, 2005

(51) Int. Cl.
*A47L 13/10* (2006.01)
*A47L 13/20* (2006.01)

(52) U.S. Cl. ..... 15/210.1; 15/209.1; 15/147.1

(58) Field of Classification Search ..... 15/210.1, 15/209.1, 145, 147.1, 147.2, 229.11, 229.13
See application file for complete search history.

(56) References Cited

U.S. PATENT DOCUMENTS

| | | | | |
|---|---|---|---|---|
| 2,271,861 | A | 2/1942 | Harris | |
| 2,635,274 | A | 4/1953 | Hatcher et al. | |
| 2,666,223 | A | 1/1954 | Farrell | |
| 2,666,224 | A | 1/1954 | Adams | |
| 2,668,974 | A | 2/1954 | Jaeger | |
| 2,816,312 | A | 12/1957 | Beck et al. | |
| 2,998,614 | A | 9/1961 | Winch | |
| 3,221,356 | A | 12/1965 | Schirmer | |
| 3,383,158 | A | 5/1968 | Leland | |
| 3,495,918 | A | 2/1970 | Leland | |
| 4,031,673 | A | 6/1977 | Hagelberg | |
| 4,075,033 | A | 2/1978 | Knox et al. | |
| 4,457,038 | A | 7/1984 | Hammond | |
| 4,493,124 | A | 1/1985 | Agapiou | |
| 4,642,836 | A | 2/1987 | Bokmiller | |
| 4,852,201 | A | 8/1989 | Wundrock et al. | |
| 4,987,634 | A | 1/1991 | Weihrauch | |
| 5,199,130 | A * | 4/1993 | Lazar | 15/229.2 |
| 5,471,697 | A | 12/1995 | Daconta | |
| 5,488,748 | A | 2/1996 | Koch | |
| 5,630,243 | A | 5/1997 | Federico et al. | |
| 5,888,002 | A | 3/1999 | Fenstersheib | |
| 6,094,771 | A | 8/2000 | Egolf et al. | |
| 6,368,003 | B1 * | 4/2002 | Sorrell | 401/185 |
| 6,463,620 | B2 | 10/2002 | Busha | |
| 6,507,972 | B2 | 1/2003 | Hart | |
| 7,287,295 | B2 * | 10/2007 | Treacy et al. | 15/210.1 |
| 7,316,046 | B2 * | 1/2008 | Michaels et al. | 15/210.1 |
| 7,386,910 | B2 * | 6/2008 | Minkler et al. | 15/145 |
| 2002/0054784 | A1 | 5/2002 | Trask | |
| 2004/0221410 | A1 * | 11/2004 | Padula | 15/210.1 |
| 2005/0138748 | A1 * | 6/2005 | Cisneros | 15/210.1 |

* cited by examiner

*Primary Examiner*—Dung Van Nguyen

(57) ABSTRACT

A toilet bowl cleaning tool comprising a hollow curved elongated outer member with a handle at the proximal end and a head at the distal end, an inner member and a disposable swab that attaches to the head. The inner member moves linearly inside the outer member, controlled by a button that protrudes through a longitudinal slot in the top of the outer member. Movement of the button affixes the disposable swab to and releases it from the head by actuating radially outwardly projecting detents which are radially expandable and retractable. When the swab is attached to the head, the detents positively engage a receptacle in the swab by gripping the end of the receptacle distant from the handle. The cleaning swab comprises multiple cleaning surfaces of loops of strips of biodegradable sheet material surrounding a biodegradable receptacle and is infused or impregnated with cleaning and disinfecting chemicals. The flat surfaces of adjacent loops are disposed at angles to each other, and the outermost ends of the loops define an imaginary, generally spherical surface. The loops are sufficiently collapsible as to be capable of conforming closely to the configuration of the particular toilet surface being cleaned, while presenting random and irregular curved surfaces and edges that contact that toilet surface at many different angles.

13 Claims, 8 Drawing Sheets

TOILET BOWL CLEANING TOOL WITH DISPOSABLE SWAB

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A "MICROFICHE" APPENDIX

Not Applicable

BACKGROUND

Cleaning toilet bowls is an unpleasant task in and of itself. More importantly, the multiple use of cleaning brushes, the only economically feasible option currently available for nonresidential use, renders the task more unsanitary than is desirable. This becomes a public health concern as it relates to the cleaning of public establishments, such as hospitals, hotels, schools, theaters and airports, facilitating the transmission of diseases from one toilet to the next. Although numerous toilet cleaning brushes with disposable swabs have been patented, I am not aware of any currently available on either the residential or nonresidential markets that have been a sustained commercial success.

From an analysis of prior art one might conclude that these products were too complicated for easy manufacture and/or use or were inadequate for the job, with such shortcomings as straight-on cleaning heads and swabs with one-sided cleaning surfaces or of insufficient bulk.

Nearly all required two hands to either attach or release the swab, which in part defeats the sanitary benefits of the disposable swab concept and reduces efficiency as compared to non-disposable tools.

Exemplary prior art consists of the following U.S. patents and applications: 2002/0054784, "Flushable Toilet Bowl Cleaning Brush"; U.S. Pat. No. 6,507,972, "Assembly of a Cleaning Device and One or More Cleansing Elements"; U.S. Pat. No. 6,463,620, "Brush Assembly with Removable/Disposable Head"; U.S. Pat. No. 6,094,771, "WC Brush with Handle and Brush Sections and Brush Storage Device"; U.S. Pat. No. 5,888,002, "Disposable Toilet Brush"; U.S. Pat. No. 5,630,243, "Toilet Cleaning Device with Cleaning Pad"; U.S. Pat. No. 5,592,713, "Toilet Mop"; U.S. Pat. No. 5,488,748, "Toilet Bowl Cleaning Implement"; U.S. Pat. No. 5,471,697, "Disposable Disintegrating Cleaning Device"; U.S. Pat. No. 4,987,634, "Implement For Cleaning or Treating Surfaces or for Applying Media to Surfaces"; U.S. Pat. No. 4,852,201, "Toilet Bowl Cleaner"; U.S. Pat. No. 4,642,836, "Cleaning Wand"; U.S. Pat. No. 4,493,124, "Toilet Cleaning Tool"; U.S. Pat. No. 4,457,038, "Handle for Disposable Brush or Mop Head"; U.S. Pat. No. 4,075,033, "Wiping Material and Holder"; U.S. Pat. No. 4,031,673, "Cleaning Device Preferably for Water Closets"; U.S. Pat. No. 3,495,918, "Disposable Swab and Holder"; U.S. Pat. No. 3,383,158, "Toilet Bowl Cleaner with Disposable Swab"; U.S. Pat. No. 3,221,356, "Disposable Cleaning Swab"; U.S. Pat. No. 2,998,614, "Holder for a Disposable Cleaning Swab"; U.S. Pat. No. 2,816,312, "Disposable Cleaning Swab and Holder Therefor"; U.S. Pat. No. 2,668,974, "Disposable Swab for Toilet Bowls"; U.S. Pat. No. 2,666,224, "Device for Cleaning Water Closet Basins"; U.S. Pat. No. 2,666,223, "Cleaning Swab for Toilet Bowls"; U.S. Pat. No. 2,648,085, "Cleaning Swab for Toilet Bowls and the Like"; U.S. Pat. No. 2,635,274, "Swab"; U.S. Pat. No. 2,271,861, "Cleaning Swab".

SUMMARY OF THE INVENTION

This invention is a toilet bowl cleaning tool with a handle at the proximal end of a curved hollow elongated member, a longitudinal slot located adjacent the handle and a head at the distal end The head has two embodiments. In embodiment I the head comprises multiple sectors including detents. In embodiment II the head comprises apertures through which detents can project. In each embodiment the head may be in either an expanded or a retracted configuration or position. (As used herein, "expanded" embraces open, extended, and deployed, and "retracted" embraces closed and contracted.) The invention further comprises a disposable swab and an inner member extending from the slot in the outer member to the head on the distal end and moving linearly within the outer member. An expander at the distal end of the inner member drives the radial expansion and contraction of the multiple head sectors in embodiment I or an extender for extending and retracting detents in embodiment II. A control button towards the proximal end protrudes through the slot in the outer member, affording the user the ability to radially expand or contract the head in embodiment I or to extend or retract the detents in embodiment II by moving it linearly in the slot. A locking mechanism at the proximal end is operatively associated with the control button by inward pressure on the button. The disposable cleaning swab, which is infused with cleaning and disinfecting chemicals, has multiple cleaning surfaces and a receptacle for insertion of the tool head for securing it to the head. It is attached to and detached from the head by linear movement of the control button. Movement of the control button forward with the head in the receptacle of the swab radially expands the head in embodiment I and extends the detents in embodiment II, attaching the swab to the head. Movement backward contracts the head and retracts the detents in the respective embodiments, detaching the swab from the head for disposal in the toilet. This construction enables the user, with only one hand, to easily and quickly complete the entire cleaning chore without touching the cleaning swab. The curved outer member and the multiple cleaning surfaces of the swab that completely surround the receptacle allow the tool to reach, and to apply sustained and controlled pressure to, all areas of the toilet that require cleaning. Preferably the curve is in the range of from 15 to 45 degrees.

DETAILED DESCRIPTION OF THE INVENTION

Figure 1:
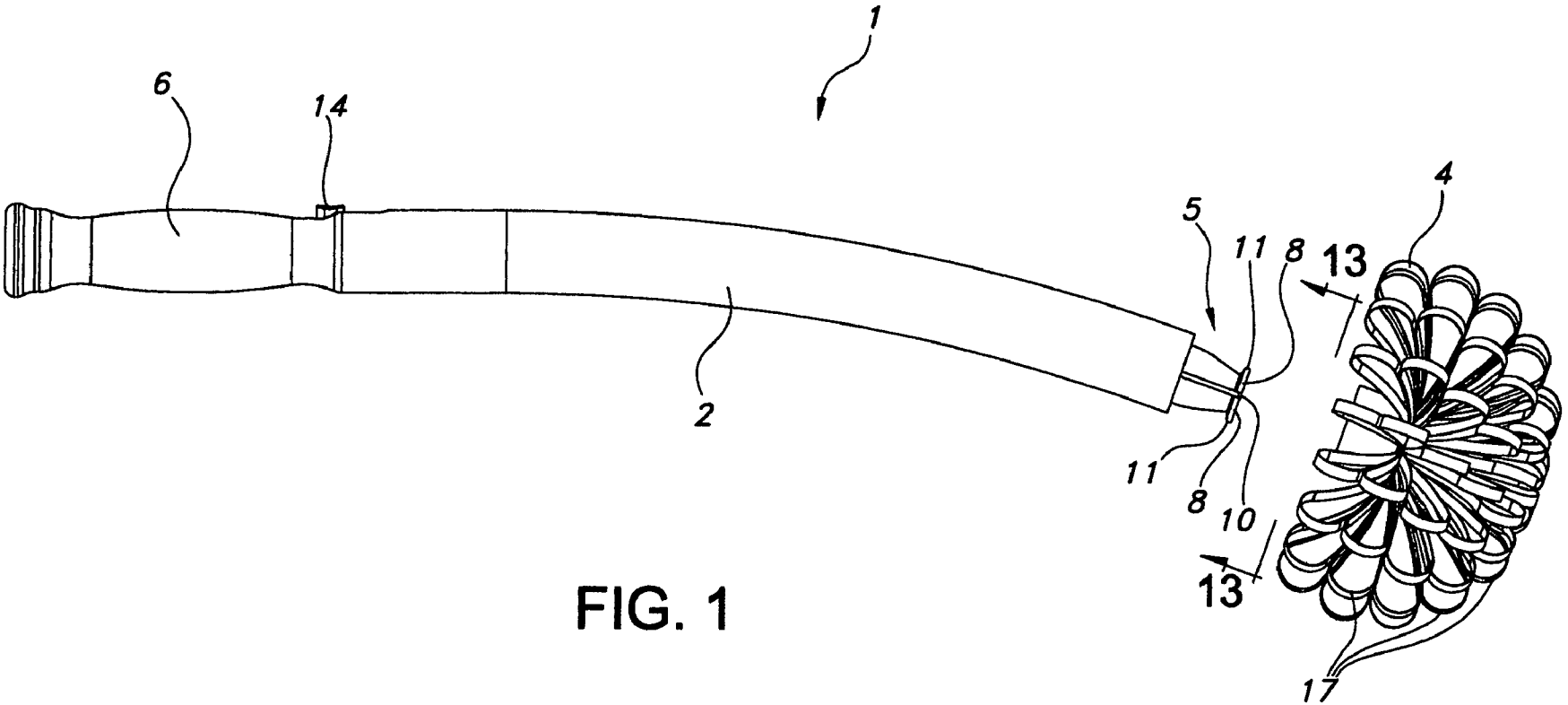
FIG. 1 is a front elevation view showing the cleaning swab and tool according to the invention, with the head of embodiment I in the closed position.
Figure 2:
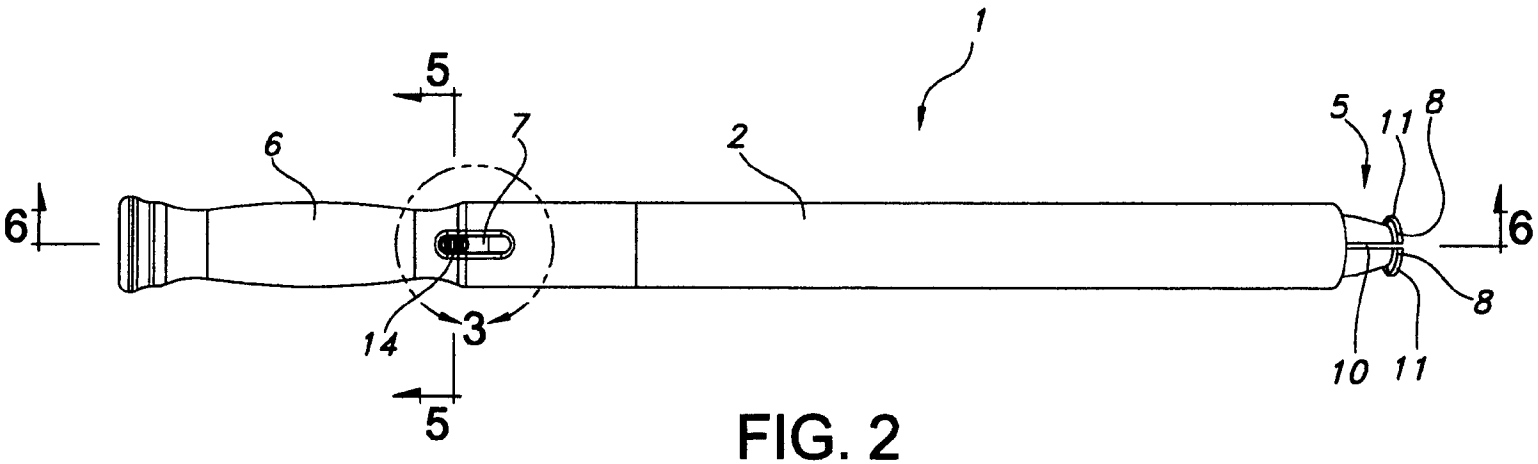
FIG. 2 is a plan view of the tool shown in FIG. 1.
Figure 5:
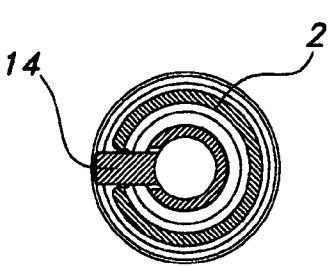
FIG. 5 is a cross section view taken along line 5-5 in FIG. 2.
Figure 4:
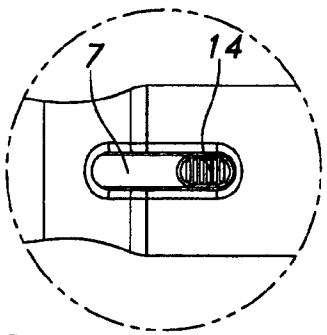
FIG. 4 is a view similar to FIG. 3, but showing the control button in the open position.
Figure 3:
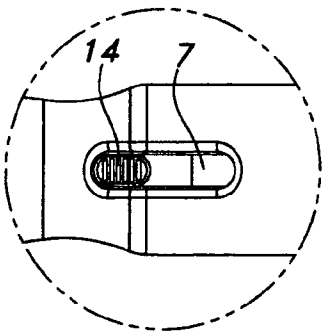
FIG. 3 is an enlarged view of detail "3" in FIG. 2, showing the control button in the closed position.
Figure 6:
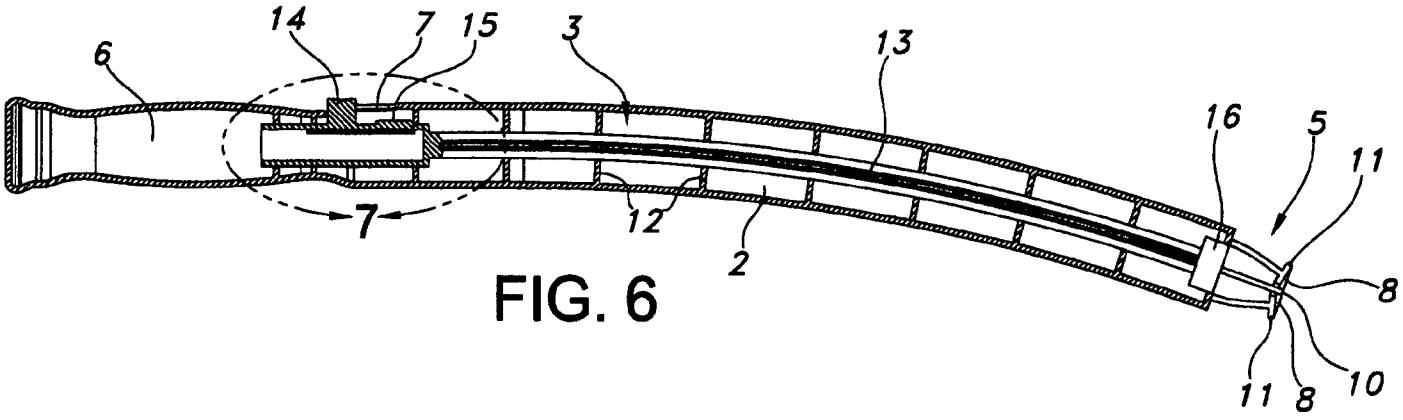
FIG. 6 is a cross section view taken along the longitudinal axis of the tool shown in FIG. 1.
Figure 8:
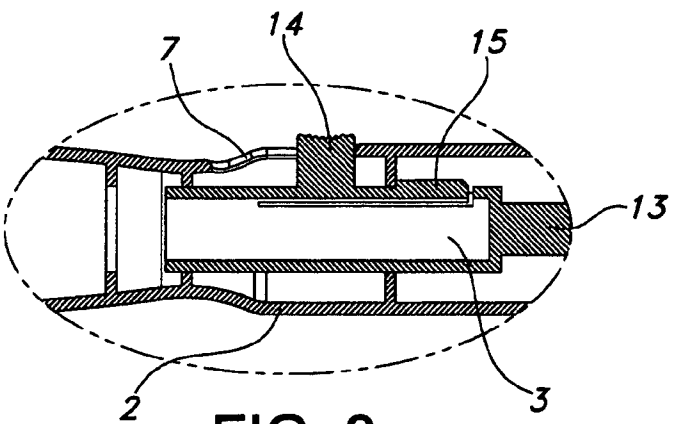
FIG. 8 is a view similar to FIG. 7, but showing the locking mechanism in the open position.
Figure 7:
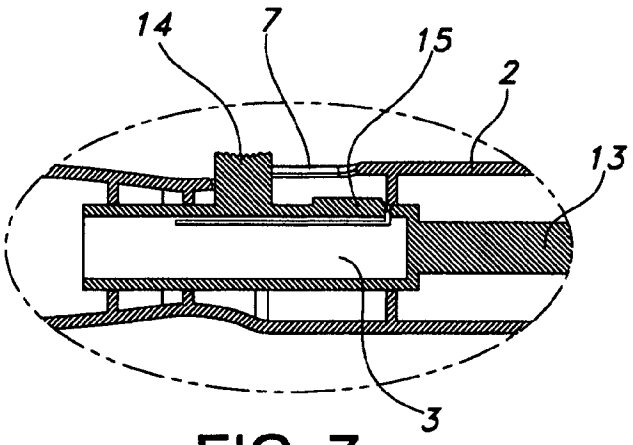
FIG. 7 is an enlarged view of detail "7" in FIG. 6, showing the locking mechanism in the closed position.
Figure 12:
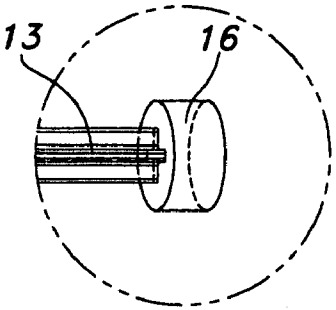
FIG. 12 is an enlarged view of detail "12" in FIG. 9.
Figure 11:
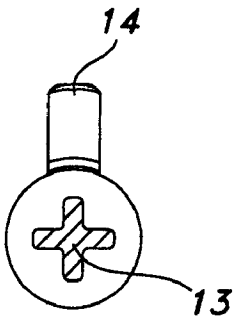
FIG. 11 is a cross section taken along line 11-11 in FIG. 10.
Figure 9:
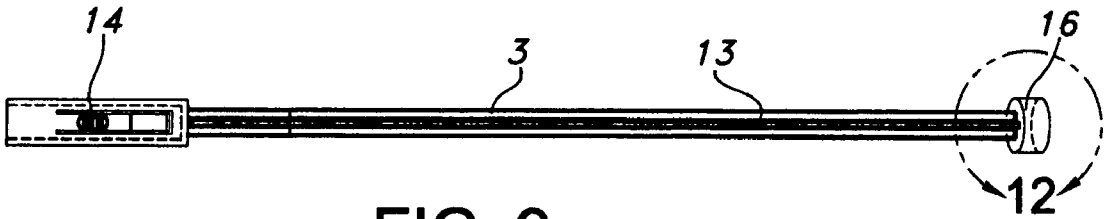
FIG. 9 is a plan view of the inner member of the tool shown in FIG. 1.
Figure 10:
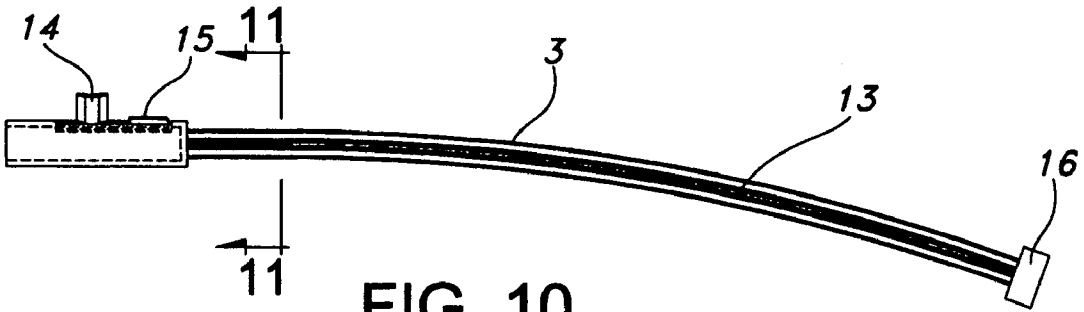
FIG. 10 is a front elevation view of the inner member shown in FIG. 9.

As shown in FIGS. 1, 2 and 6, a toilet bowl cleaning tool 1 consists of an elongated, curved, tubular outer member 2 and an inner member 3, comprising a mechanism for simple attachment and detachment of disposable cleaning swabs 4.

Figure 15:
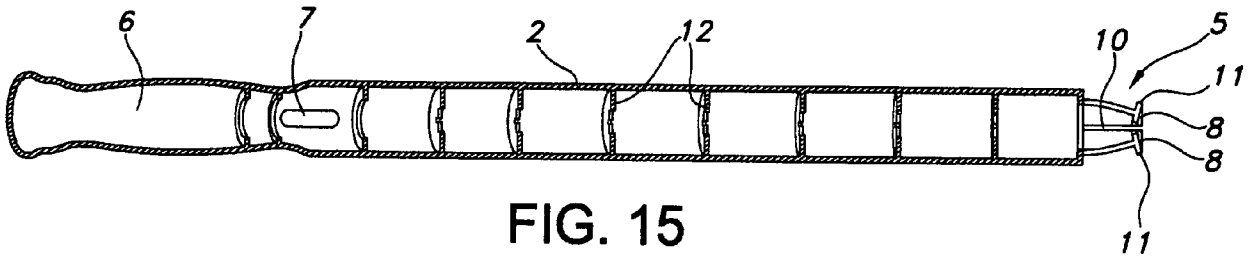
FIG. 15 is a cross section view taken along the longitudinal axis of the tool shown in FIG. 2, as viewed from below the tool.

The tool 1 comprises a head 5 at the distal end and a handle 6 on the proximal end of the outer member, as shown in FIGS. 1, 2 and 6. Slot 7, shown in FIGS. 2, 3, 4, 6, 7, 8 and 15, is on the top of the outer member 2 adjacent the handle 6 where the thumb of the grasping hand rests. The distal end embodies the head 5 for holding the cleaning swab 4. From the distal end of the slot 7 in the outer member 2 to the head 5, guides 12, as shown in FIGS. 6 and 15, protrude inwardly forming a cross-shaped channel in which the actuation rod 13 of the inner member 3 moves, as shown in FIGS. 6, 7, 8, 9, 10, 11, 12, 16, 17, 21, 23, 24 and 25.

The inner member 3, which moves linearly inside the outer member 2, is comprised of a control button 14, as shown in FIGS. 1, 2, 3, 4, 5, 6, 7, 8, 9, 10 and 11, and locking mechanism 15, as shown in FIGS. 6, 7, 8 and 10, at the proximal end, an expander 16 or extender 21 at the distal end and an actuation rod 13 between the two ends, as shown in FIGS. 6, 9, 10, 11, 12, 16, 17, 21, 23, 24 and 25. The control button 14 protrudes through the slot 7 in the outer member 2. Movement of the control button 14 within the slot 7 moves the inner member 3 accordingly. Movement toward the head 5 attaches the swab 4 to the head 5 and movement towards the handle 6 releases the swab 4 from the head 5. The locking mechanism 15 retains the head 5 in the attached and detached modes and is released by pressing inward on the control button 14.

The swab 4, as shown in FIGS. 1, 16, 17, 24 and 25, has multiple cleaning surfaces comprised of loops 17 of biodegradable sheet material strips, which may be paper, infused with cleaning and disinfecting agents extending from a wider band of sheet material at each end, which when doubled on themselves and wound together in a cylindrical shape form a receptacle 18 encompassed by the loops 17. The receptacle 18, as shown in FIGS. 16, 17, 24 and 25, receives the head 5 of the tool 1 for attachment thereto.

As will be seen in the drawings, The loops 17, which have a multiplicity of exposed flat surfaces and edges between the flat surfaces, project longitudinally outward from the receptacle in a direction along and parallel to the longitudinal axis of the receptacle and, in directions perpendicular to that axis, project radially outward so as to surround the receptacle radially in 360 degrees. The outermost ends of the loops define an imaginary, generally spherical surface that surrounds the receptacle and has a diameter in those perpendicular directions which is substantially greater than the outer diameter of the receptacle. The loops are not aligned with each other or with the longitudinal axis. As viewed in a cross-section taken perpendicular to the longitudinal axis of the receptacle, adjacent loops are disposed at angles to each other. Thus, they do not merely present outer surfaces that make flat contact with the particular area of the toilet surface being cleaned, but instead present random and irregular curved surfaces and edges which contact that toilet surface at many different angles. The loops are sufficiently collapsible as to be capable of conforming closely to the configuration of the particular area of the toilet surface being cleaned. The generally spherical surface extends over an angle of approximately 180 degrees in a plane including the longitudinal axis of the receptacle, and thus the swab is multi-directional, in that the user does not need to orient the tool at a precise angle or thrust it in a single direction to clean irregular or hard-to-reach toilet surfaces.

In embodiments I and II, which will now be described, radially outwardly projecting detents on the head are expandable and retractable in a plane perpendicular to the longitudinal axis of the tool. When the head is within the receptacle, the end of the receptacle distant from the handle is slightly closer to the handle than said plane is to the handle, so that the detents positively engage the receptacle by gripping that end of the receptacle.

EMBODIMENT I

Figure 14:
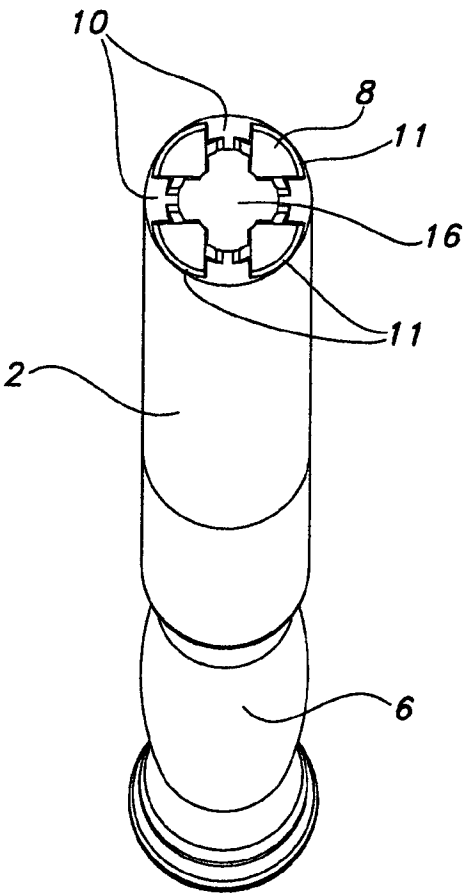
FIG. 14 is a view similar to FIG. 13, but showing the head in the open or expanded position.
Figure 13:
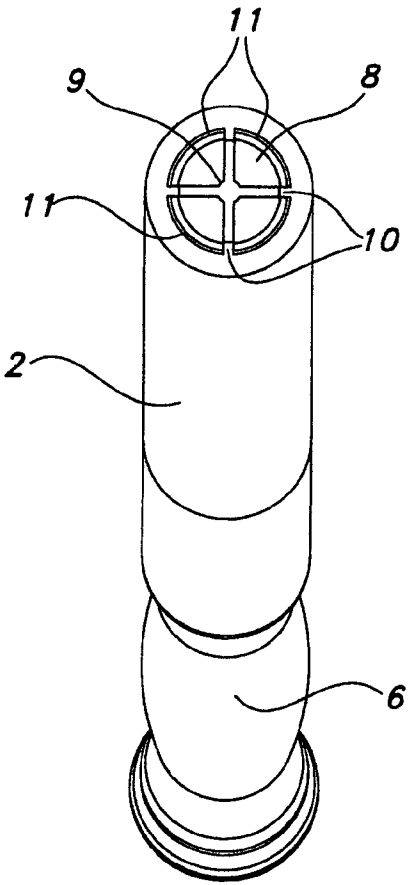
FIG. 13 is an end view of the distal end of the tool shown in FIG. 1, showing the head in the closed or retracted position.

The head 5 is conical and radially expandable with a plurality of sectors 8 surrounding an opening 9 in the center, as shown in FIGS. 13 and 14. Slots 10 extend from the end into the head 5, dividing it into the sectors with radially extended detents 11 on the perimeter of the sectors' ends, as shown in FIGS. 1, 2, 6, 15, 16, 17, for securing the receptacle to the head 5 when it is expanded, as shown in FIG. 17.

Figure 17:
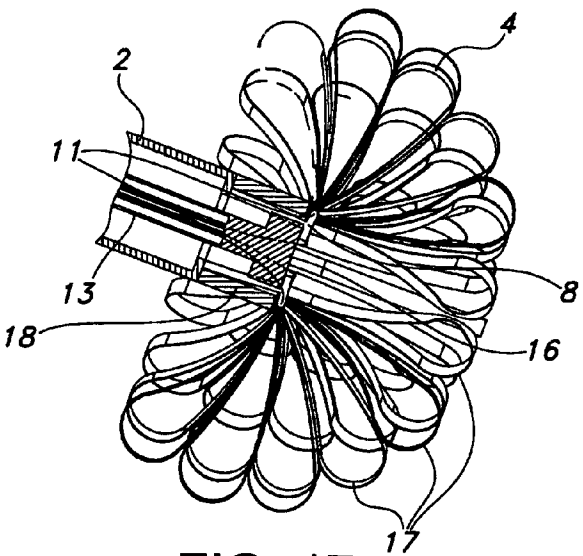
FIG. 17 is a view similar to FIG. 16, but showing the swab connected to the tool with the head in the open position.
Figure 16:
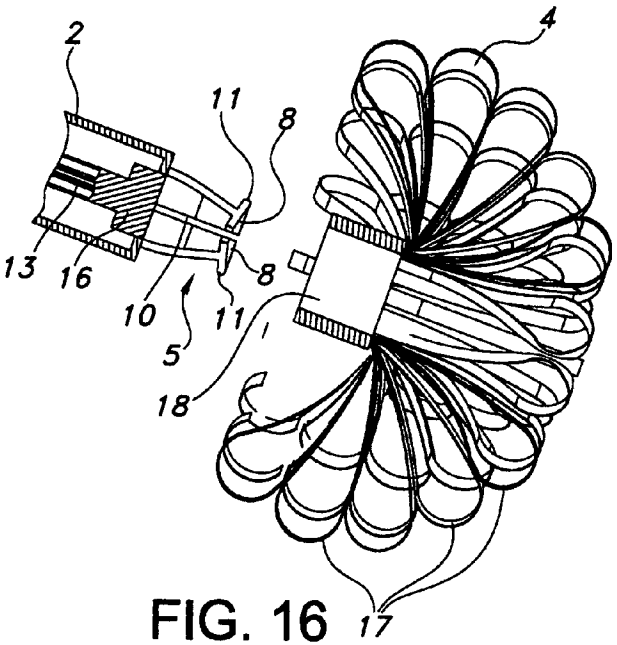
FIG. 16 is a cross section view taken along the longitudinal axis of the tool and swab shown in FIG. 1.
Figure 18:
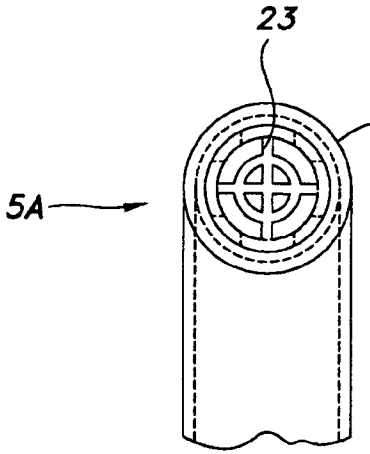
FIG. 18 is an end view of the head of embodiment II of the invention.

An expander 16, as shown in FIGS. 9, 10, 12, 16 and 17, is also part of the head 5. It comprises the distal end of the actuation rod 13. It is the shape of the inside of the proximal end of the head and is an extension of the actuation rod 13, which connects it to the control button 14 at the proximal end of the inner member 3. When the head 5 is in the contracted position, the expander is positioned at the base of the inside of the sectors 8 at their widest point, or proximal end, as shown in FIG. 16. To attach the swab 4, the head 5, with the expander 16 in the retracted position, is inserted into the receptacle 18 of the swab 4 and the control button 14 is moved forward, forcing the expander against the inner sides of the sectors 8, radially expanding them and the detents 11, securing the swab to the head 5, as shown in FIGS. 16 and 17, by the detents 11 extending over the distant end of the receptacle 18 in the swab 4. In this position the expander 16 is fully forward and its face is flush with the end sectors of the expanded head 5, filling the opening 9, as shown in FIGS. 14 and 17, enlarged by the expansion of the sectors 8, providing a continuous surface for exerting scrubbing pressure with the swab 4. To release the cleaning swab 4, the control button 14 is moved toward the handle 6, retracting the expander 16 and allowing the sectors 8 and detents 11 to contract and release the swab 4 from the head 5 for disposal in the toilet.

EMBODIMENT II

Figure 22:
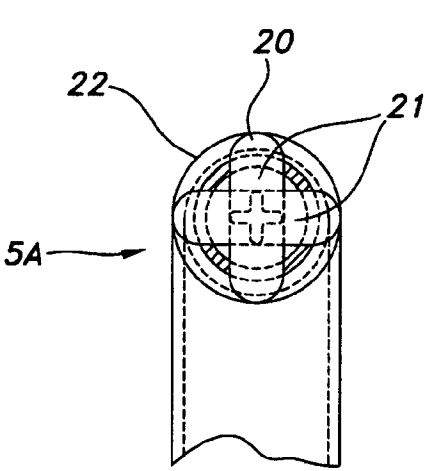
FIG. 22 is a view similar to FIG. 20, but showing the detents in the extended position.
Figure 19:
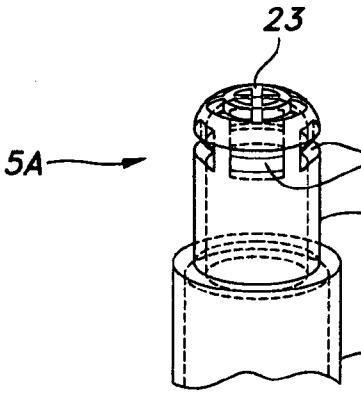
FIG. 19 is a perspective view of the head shown in FIG. 18.
Figure 23:
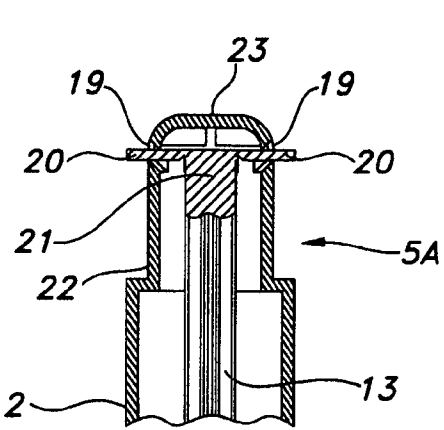
FIG. 23 is an axial cross section of the head shown in FIG. 22.
Figure 25:
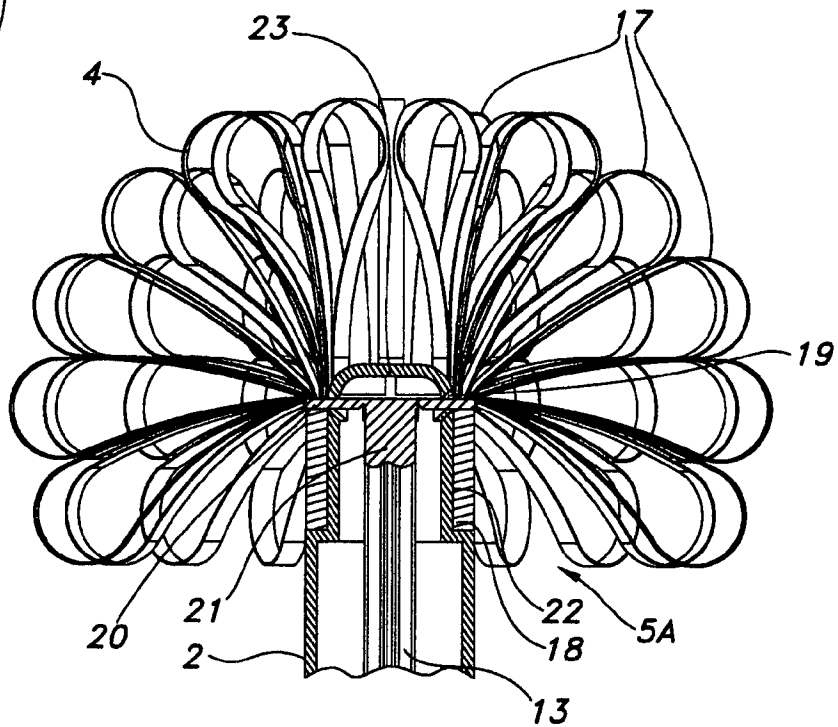
FIG. 25 is a view similar to FIG. 17 for the head of embodiment I, but showing the head of embodiment II.

The head 5A includes a head tube 22 which has a partially enclosed end 23 in a latticework pattern, as shown in FIGS. 18, 19, 20, 21, 23, 24 and 25. Marginally back from the end of the head 5A are four apertures 19, FIGS. 19, 21, 23, 24 and 25. Detents 20 emerge through the openings in tube 22 to affix the cleaning swab 4 to the head, as shown in FIGS. 22, 23 and 25.

Figure 20:
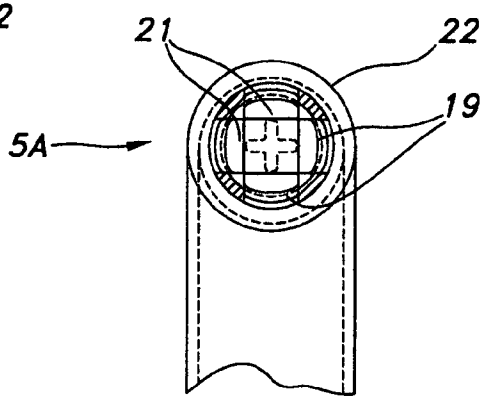
FIG. 20 is a view similar to FIG. 18, cut away to show the detents in the retracted position.
Figure 21:
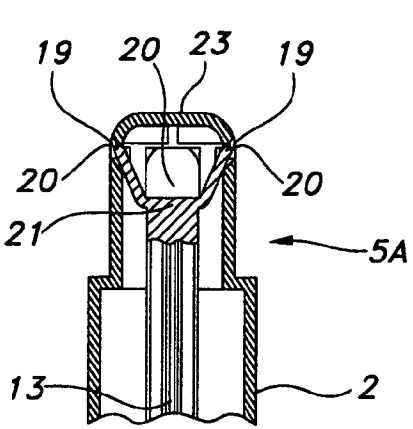
FIG. 21 is an axial cross section of the head shown in FIG. 19.
Figure 24:
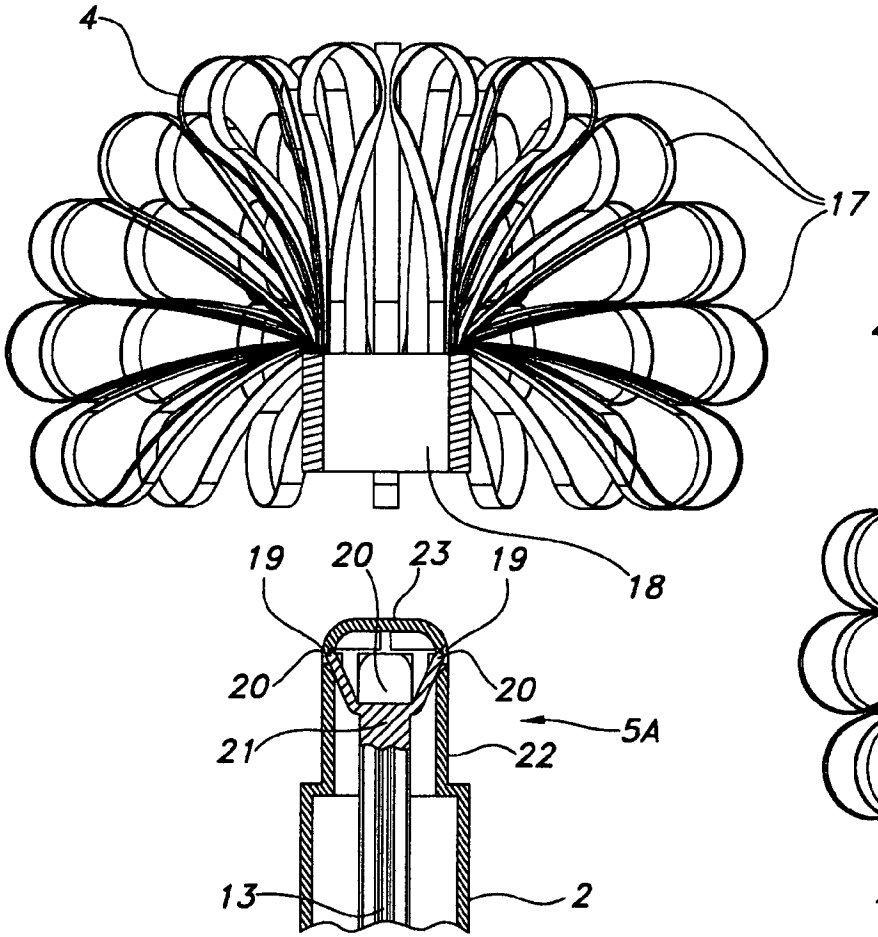
FIG. 24 is a view similar to FIG. 16 for the head of embodiment I, but showing the head of embodiment II.

The detents 20 are the tips of four arms of a detent extender 21, as shown in FIGS. 20,21, 22, 23, 24 and 25, which comprises the distal end of the actuation rod 13 and is an extension thereof, connecting it to the control button 14 at the proximal end of the inner member 3. The four arms when radially extended have a circumference greater than that of the head 5 by an amount equal to the length of the detents 20. The arms have living hinges allowing them to fold and fit within the head when in the retracted position, as shown in FIGS. 20, 21 and 24. With the detents 20 contracted, as shown in FIG. 21, the extender 21 is positioned at the proximal end of the head 5, the four arms sloping upward toward the end 23 of the head 5A and with the detents 20 lying just inside the apertures 19 in the head 5A. To attach the swab 4, the head, with the extender in the retracted mode, as shown in FIGS. 20, 21 and 24, is inserted into the receptacle 18 of the swab 4 and the control button 14 is moved forward, extending the detents 20 through the openings 19, as shown in FIGS. 22, 23 and 25, over the distant end of the receptacle 18 in the swab 4 securing it to the head 5A. To release the cleaning swab 4 from the head 5, the control button 14 is moved toward the handle 6, contracting the detents 20, as shown in FIGS. 20, 21 and 24, and releasing the swab 4 from the head 5A for disposal in the toilet.

It will be understood that, while presently preferred embodiments of the invention have been illustrated and described, the invention is not limited thereto, but may be otherwise variously embodied within the scope of the following claims. It will also be understood that the method claims are not intended to be limited to the particular sequence in which the method steps are listed therein, unless specifically stated therein or required by description set forth in the steps.

The invention claimed is:

1. A toilet bowl cleaning tool comprising:

(a) an elongated, tubular outer member having a longitudinal axis, a proximal end, and a distal end;

(b) an inner member linearly moveable within the outer member;

(c) a handle at the proximal end of the outer member;

(d) a disposable, flushable cleaning swab having a receptacle to receive the head of the outer member for attachment thereto;

(e) a head at the distal end of the outer member, which head is shaped to fit closely within, and support, the receptacle in the swab; and (f) radially outwardly projecting detents on the head, which detents are expandable and retractable in a plane perpendicular to said longitudinal axis, so that, when the head is within the receptacle, (i) the end of the receptacle distant from the handle is closer to the handle than said plane is to the handle, and (ii) the detents positively engage the receptacle by gripping said end of the receptacle;

whereby the user, after cleaning a toilet with the swab secured to the outer member and the head disposed within the receptacle in the swab, is able to release the swab from the head for disposal in the toilet.

2. A tool according to claim 1 wherein:

(a) the outer member has a slot which is parallel to the longitudinal axis and is located adjacent the handle and between the handle and the head;

(b) a control button mounted on the inner member protrudes through the slot and extends a substantial radial distance beyond the outer surface of the outer member; and (c) the control button has a locking mechanism to fix the head in the attached or detached position;

whereby the user, with only one hand, is able to easily and quickly complete the entire cleaning chore without touching the cleaning swab.

3. A tool according to claim 1 wherein the detents are on sectors of the outer member, the head is conical, and the tool further comprises an expander which is disposed at the base of the head and is operatively associated with the head.

4. A tool according to claim 1 wherein the detents move in and out of apertures in a tubular, cylindrical portion of the outer member.

5. A tool according to claim 1 wherein the swab is comprised of multiple cleaning surfaces surrounding the receptacle, which cleaning surfaces are created by the exposed surfaces and edges of closely nested, collapsible loops of strips of sheet material;

whereby the receptacle, when in a relaxed and dry condition prior to attachment of the swab to the tool, is sufficiently rigid as to present an opening for the easy insertion of the head; and whereby the receptacle and the loops, when the receptacle is in a relaxed and wet condition after detachment of the swab from the tool, are sufficiently flexible and collapsible as to prevent the swab from becoming lodged in the exit passages of a toilet.

6. A tool according to claim 1 wherein the head includes a tube which is cylindrical and comprises on its sides, spaced a short distance from its distal end, a plurality of four lateral oblong apertures; and wherein the tool further comprises a detent extender which (i) is disposed within the tube, (ii) is operatively associated with the tube, (iii) is cross-shaped, (iv) has four arms with a diameter larger than the diameter of the tube and (v) has at the ends of the arms four detents extending through the apertures.

7. A tool according to claim 6 wherein (i) the extender has living hinges in each of four arms allowing them to partially fold toward the end of the head when in the retracted position, (ii) the detents lie just inside the apertures when the extender is in the retracted position and (iii) the detents protrude through the apertures when the arms are unfolded in the expanded position;

whereby the detents when expanded grip the inner end of the receptacle, attaching the swab to the head; and whereby the user, after cleaning a toilet with the swab secured to the head and the head disposed within the receptacle in the swab and the detents extended, is able to release the swab from the head by causing the detents to retract.

8. A disposable, flushable, multi-directional cleaning swab comprising:

(a) a cylindrical, collapsible receptacle for receiving the head of a toilet bowl cleaning tool, which receptacle has a longitudinal axis and an outer diameter; and (b) closely nested, collapsible loops of strips of sheet material attached to the receptacle, surrounding the receptacle radially in 360 degrees about said axis, and having a multiplicity of exposed flat surfaces and edges, wherein the flat surfaces of adjacent loops are not aligned, but rather are disposed at irregular angles to each other and to said axis, so that the loops do not merely present outer surfaces which make flat contact with the particular toilet surface to be cleaned, but also present random and irregular curved surfaces and edges which contact that toilet surface at many different angles;

whereby the receptacle, when in a relaxed and dry condition prior to attachment of the swab to the tool, is sufficiently rigid as to present an opening for the convenient insertion of the head; and whereby the receptacle and the loops, when the receptacle is in a relaxed and wet condition after detachment of the swab from the tool, are sufficiently flexible and collapsible as to prevent the swab from becoming lodged in the exit passages of a toilet.

9. A swab according to claim 8 wherein the outermost ends of the loops define an imaginary, generally spherical surface which, in a plane perpendicular to said longitudinal axis, has a diameter that is substantially greater than the outer diameter of the receptacle.

10. A swab according to claim 8 wherein the loops are sufficiently collapsible as to be capable of conforming closely to the configuration of the particular toilet surface to be cleaned.

11. A toilet bowl cleaning tool comprising:

(a) an elongated, tubular outer member having a longitudinal axis, a proximal end, and a distal end;

(b) an inner member linearly moveable within the outer member;

(c) a handle at the proximal end of the outer member;

(d) a disposable, flushable cleaning swab according to claim 8; and (e) a head at the distal end of the outer member, which head is shaped to fit closely within, to support, and to engage the receptacle of the swab for attachment to the head;

whereby the user, after cleaning a toilet with the swab secured to the outer member and the head disposed within the receptacle in the swab, is able to release the swab from the head for disposal in the toilet by moving the inner member within the outer member.

12. A tool according to claim 11 wherein the outermost ends of the loops define an imaginary, generally spherical surface which, in a plane perpendicular to said longitudinal axis, has a diameter that is substantially greater than the outer diameter of the receptacle.

13. A tool according to claim 11 wherein the loops are sufficiently collapsible as to be capable of conforming closely to the configuration of the particular toilet surface to be cleaned.

* * * * *